US007845281B2

(12) United States Patent
Sexton

(10) Patent No.: US 7,845,281 B2
(45) Date of Patent: Dec. 7, 2010

(54) GUN FIRING METHOD FOR THE SIMULTANEOUS DISPERSION OF PROJECTILES IN A PATTERN

(76) Inventor: Richard Frank Sexton, 3331 SW. 104th Ct., Miami, FL (US) 33165

( * ) Notice: Subject to any disclaimer, the term of this patent is extended or adjusted under 35 U.S.C. 154(b) by 602 days.

(21) Appl. No.: 11/809,412

(22) Filed: Jun. 2, 2007

(65) Prior Publication Data

US 2010/0282110 A1 Nov. 11, 2010

Related U.S. Application Data

(63) Continuation-in-part of application No. 11/340,150, filed on Jan. 23, 2006, now abandoned.

(51) Int. Cl.
*F42B 10/00* (2006.01)
*F42B 10/60* (2006.01)
*F42B 30/02* (2006.01)

(52) U.S. Cl. ..... 102/439; 102/438; 102/501; 102/506; 102/517

(58) Field of Classification Search ..... 102/506, 102/439, 438, 501, 517
See application file for complete search history.

(56) References Cited

U.S. PATENT DOCUMENTS

| | | | | | |
|---|---|---|---|---|---|
| 15,369 | A | * | 7/1856 | Buckel et al. | 102/438 |
| 122,620 | A | * | 1/1872 | Maduell | 102/506 |
| 216,974 | A | * | 7/1879 | Rice | 102/506 |
| 221,249 | A | * | 11/1879 | Howlan | 102/506 |
| 275,674 | A | * | 4/1883 | Littlepage | 102/506 |
| 588,764 | A | * | 8/1897 | Boss | 102/436 |
| 620,875 | A | * | 3/1899 | Baker | 102/506 |
| 3,097,603 | A | * | 7/1963 | Harper | 102/506 |
| 3,208,386 | A | * | 9/1965 | Schneider et al. | 102/506 |
| 3,357,357 | A | * | 12/1967 | Voss | 102/516 |
| 3,401,637 | A | * | 9/1968 | Briscoe | 102/501 |

(Continued)

OTHER PUBLICATIONS

Operations Research Office at John Hopkins University under contract with the Department of the Army (Report) "Optimum Dispersion for GaussianSalve" Authors G. Trevor Williams and Published in U.S. Kenneth L. Yudowitch in Aug. 1957.

(Continued)

*Primary Examiner*—James S Bergin

(57) ABSTRACT

A gun firing method whereby multiple projectiles segments that are contained within a cartridge are fired simultaneously in a symmetrical pattern. Some of the multiple projectile segments are modified by moving the center of mass of the projectile segments away from the central longitudinal axis of the cartridge. This in combination with bring fired from a rifled gun barrel will impart velocity to the modified projectile segments upon exiting the gun barrel at right angles to the gun barrel. This velocity along with the higher muzzle velocity will cause the modified projectile segments to diverge away from the trajectory of a standard projectile segment and strike the target away from the bullseye. The magnitude of the divergence will vary with the distance the projectile segment's center of mass is away from the central longitudinal axis of the cartridge. The placement of the modified projectile segments strikes around the bull's-eye will be determined by the orientation of the centers of mass of the modified projectile segments prior to firing. Simultaneously firing a multiplicity of standard and modified projectile segments will produce a symmetrical pattern on a target, which will substantially increase the hit probability of a gun.

14 Claims, 11 Drawing Sheets

U.S. PATENT DOCUMENTS 3,855,931 A * 12/1974 Dardick ..... 102/436
4,765,566 A * 8/1988 Fixell et al. ..... 244/3.23
5,295,439 A * 3/1994 Carbone ..... 102/438
5,505,137 A * 4/1996 Godefroy et al. ..... 102/529
5,648,637 A * 7/1997 Clark, III ..... 102/438
7,017,495 B2 * 3/2006 Sexton ..... 102/439

OTHER PUBLICATIONS

Harald Vaughn "Bullet Imbalance" (Chapter 9 of Rifle Accuracy Facts) found on the internet Jan. 11, 2004 Published in the U.S.

* cited by examiner

GUN FIRING METHOD FOR THE SIMULTANEOUS DISPERSION OF PROJECTILES IN A PATTERN

This is a continuation in part of U.S. patent application Ser. No. 11/340,150 Filed Jan. 23, 2006, now abandoned.

BACKGROUND OF INVENTION

With the advent of guns and firearms much effort has been devoted to their perfection in the art of firing projectiles to hit specified targets. An important factor to consider relating to the firing of a gun is the hit probability of the weapon.

A shotgun increases the hit probability by firing multiple projectiles in a random dispersion. An automatic weapon increases the hit probability by firing a random dispersion of projectiles toward a target, thereby covering a broad area around a target and assuring a greater chance of striking the target.

In 1952 a report for the U.S. Army by the Operations Research Office "Operational Requirements for an Infantry Hand Weapon" analyzed firing a salvo of 5 projectiles in a diamond shaped pattern, and found the concept would greatly increase the hit probability of a weapon. With the "pattern-dispersion principle" each projectile had a predetermined hit point in the dispersion, was separated from the other projectiles, and the diamond shaped salvo efficiently maximized the lethal area, and the hit probability of the dispersion Although the U.S. Army determined that the "pattern salvo weapon" or "dispersion weapon" would be very effective and recommended that the Ordinance Corp. proceed to develop a pattern salvo weapon for the Infantry, a practical weapon that fired the 5 shot diamond shaped pattern was never developed.

SUMMARY OF THE INVENTION

With the present invention 5 projectile segment diamond shaped pattern dispersion salvos, 3 projectile segment horizontal pattern dispersion salvos, and other pattern salvos can be fired from rifles and handguns used for personal defense at short range. The energy available by firing a rifle, or a more powerful handgun, can be efficiently used by firing multiple projectile segments in a wide predetermined symmetrical pattern, to greatly increase the hit probability of the gun. A wide pattern dispersion salvo in these situations will compensate somewhat for imprecise aiming.

An optimum sized pattern dispersion salvo can be fired from a rifle or handgun to substantially increase the hit probability of the weapon in defensive situations that necessarily require fast reactions. Rifles and handguns used for personal defense are fired with short target exposure times and large aiming errors.(footnote 1) The average aiming error for these short target exposure times can be taken into account, and an optimal dispersion in which the standard radial deviation of the dispersion is 50%-100% of the aiming error can be fired. (footnote 2) Many rifles and handguns firing the second embodiment of the cartridge will fire pattern dispersion salvos generally within this optimal dispersion. Hit probability increases for the pattern dispersion salvos vary widely with the number of projectiles in the salvo, range, and aiming error, but many rifles and handguns, fired quickly in a defensive situation, will have on the order of 100% or more increase in hit probability by firing a pattern dispersion salvo compared to firing a single shot.(footnote 3)

Footnote-1 "Rifle, Carbine, and Pistol Aiming Error as a Function of Target Exposure Time" 1955 report by the Operations Research Office for the U.S. Army Footnote 2 "Hit Probability on a Tank Type Target" 1966 report by the Frankford Arsenal The report indicates the size of a dispersion to maximize the hit probability for a salvo of projectiles.

Footnote 3 "Operational Requirements for an Infantry Hand Weapon" has graphs of hit probabilities of a diamond shaped pattern dispersion salvo compared to one shot for several aiming errors. These graphs can be adjusted for the wider dispersions and shorter ranges of the present invention. Graphs of 3 projectile segment horizontal pattern dispersion salvos compared to a single shot can also be constructed from information in "Operational Requirements". Tables for multiple projectile strikes on a target by firing a diamond shaped pattern at various ranges and aiming errors are also presented.

The invention is a method for a simultaneous dispersion of projectiles in a predetermined symmetrical pattern from a gun. A projectile of substantially normal size and weight, with a diameter slightly larger than that of the gun barrel, is divided into multiple projectile segments, and positioned within a cartridge case. The projectile segments that together make up the larger projectile have some or all of their side surfaces substantially coinciding with the circumference of the larger projectile. The invention consists of firing these multiple projectile segments simultaneously from a gun and having those projectile segments strike the target in a predetermined symmetrical pattern. Firing a symmetrical pattern of projectile segments significantly increases the hit probability of the gun. The multiple projectile segments that are contained within a cartridge case consists of specialized projectile segments and standard projectile segments. Each of the specialized projectile segments a contained within a cartridge case consists of specialized projectile segments and standard projectile segments. Each of the specialized projectile segments strike the target at a predetermined hit point away from the bullseye. This is accomplished by removing mass from the circumference of the projectile segment. The center of mass of the projectile segment is no longer on the central longitudinal axis of the cartridge and the centrifugal force from the projectile segment spinning in the gun barrel, because of the rifling, imparts a force on the projectile at right angles to the gun barrel. Upon exiting the gun barrel, this velocity, along with the much higher muzzle velocity determines how far away from the bullseye the projectile segment will strike. More mass taken from the circumference of the projectile segment will result in the projectile segment striking the target further away from the bullseye.

The orientation of the projectile segment strikes around the bullseye from multiple projectile segments with a center of mass offset from the central longitudinal axis of the cartridge is determined by the orientation of the specialized projectile segments in the chamber of the gun when fired.

The diamond shaped pattern is one pattern that could be fired repeatedly with a magazine that feeds the cartridges to the gun in the proper rotational orientation. However, a random rotational orientation of the 5 part diamond shaped pattern from a standard magazine in a gun would also increase the hit probability of the gun substantially compared to a single shot.

One way the projectile segments that are designed not to hit the bullseye can be formed is to have mass removed from the side of the projectile segments, or the ends in such a way that the center of mass of the projectile segments are no longer on the central longitudinal axis of the cartridge. The center of mass of the projectile segment can also be moved from the central longitudinal axis of the cartridge by adding mass to the projectile segment on the circumference.

A standard weight projectile can be divided into several smaller projectile segments with the accumulated weight of the smaller projectile segments approximating the weight and volume of the standard projectile. One way these smaller projectile segments can be arranged in the cartridge is one ahead of the other, with at least two of the projectile segments having a center of mass away from the central longitudinal axis of the cartridge. The length of the multiple projectile segments that are fired simultaneously are usually shorter than a standard projectile. Flat ends that are 90 degrees to the central longitudinal axis of the cartridge are depicted in the drawings for the projectile segments, however many other projectile segment shapes are possible.

If two projectile segments, with centers of mass offset from the central longitudinal axis of the cartridge, are arranged with the centers of mass approximately 180 degrees apart in the cartridge, the dispersion pattern on the target would be one projectile segment strike on one side of the bullseye and the second projectile segment strike on the opposite side. A horizontal two shot dispersion pattern would be created with the proper rotational orientation of the cartridge in the chamber of the gun when fired. Adding a third projectile segment that had a center of mass on the central longitudinal axis of the cartridge, would create a three shot horizontal dispersion pattern with the central shot going to the bullseye.

Another embodiment of the invention that produces maximum dispersion for greater hit probabilities at short ranges is to arrange three projectile segments in the cartridge case where a cylindrical rear standard projectile segment is behind two front projectile segments that are side by side in the cartridge case. The center of mass of each of the two front projectile segments is offset from the central longitudinal axis of the cartridge. When loaded in the proper rotational orientation, and fired from a gun, this embodiment produces a wide 3 shot horizontal dispersion pattern.

A five projectile segment cartridge that is similar in design to the 3 projectile segment cartridge above will produces a wide diamond shaped dispersion pattern. A cylindrical rear standard projectile segment is behind four projectile segments that are positioned side by side in the cartridge case, each one occupying a 90 degree section. Each of the four forward projectile segments have a center of mass that is offset from the central longitudinal axis of the cartridge. This cartridge will produces a wide diamond shaped dispersion pattern from the 5 projectile segments when loaded in the proper rotational orientation and fired from a gun.

The 3 and 5 projectile segment cartridges above provide wide symmetrical patterns that greatly increase the hit probability of the gun.

Revolvers are particularly well suited to firing 3 projectile segment pattern dispersion salvos. The cartridges are straight sided, easier to assemble, and setback of the projectile segments is not a concern as in necked down cartridges. The rotational orientation of the multiple cartridges in the cylinder is precise. Flat ended multiple projectile segment cartridges can be fired which promotes the two forward side by side projectile segments to spin on their for and aft central axis after firing, and leave a semicircular imprint on the target at their strike points in a three projectile segment horizontal pattern dispersion salvo.

DETAILED DESCRIPTION OF THE INVENTION

Figure 1:
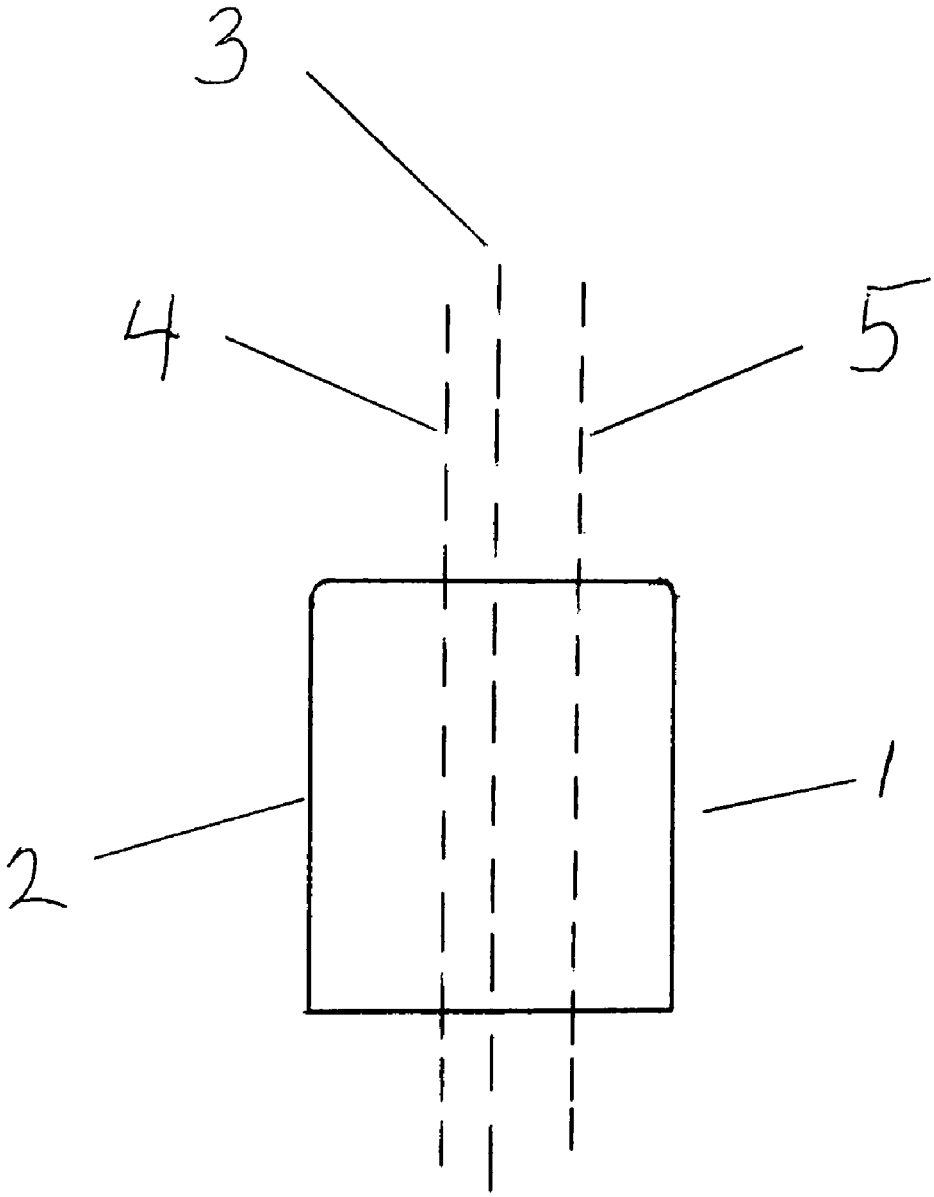
FIG. 1 is a side view of a projectile segment.

The invention represents a device and method for creating a predetermined symmetrical pattern of strikes on a target. The patterns are created by dividing a projectile into multiple projectile segments and by firing the multiple projectile segments simultaneously from a gun. The multiple projectile segments are positioned within a cartridge case. FIG. 1 reveals one of the projectile segments that may be positioned within a cartridge case along with other projectile segments. The projectile segment 1 has a central longitudinal axis 3 running longitudinally in the center of the projectile, which would also run longitudinally in the center of the cartridge containing projectile segment 1. The projectile segment 1 has a side surface 2. The projectile segment 1 has a center of mass that is not aligned with, and separate from the central longitudinal axis 3. The center of mass of the projectile segment 1 can be located a distance from the central longitudinal axis 3 such as center of mass 4 and center of mass 5. The center of mass of the projectile segment 1 can be located in many locations off the central longitudinal axis 3, as center of masses 4 and 5 are merely examples. The invention consists of firing multiple projectile segments simultaneously, with at least two of the projectile segments having centers of mass offset from the central longitudinal axis of the cartridge as in FIG. 1. Standard projectile segments with the center of mass lying along the central longitudinal axis of the cartridge may be included in the multiple projectile segments that are contained in the cartridge.

Figure 2:
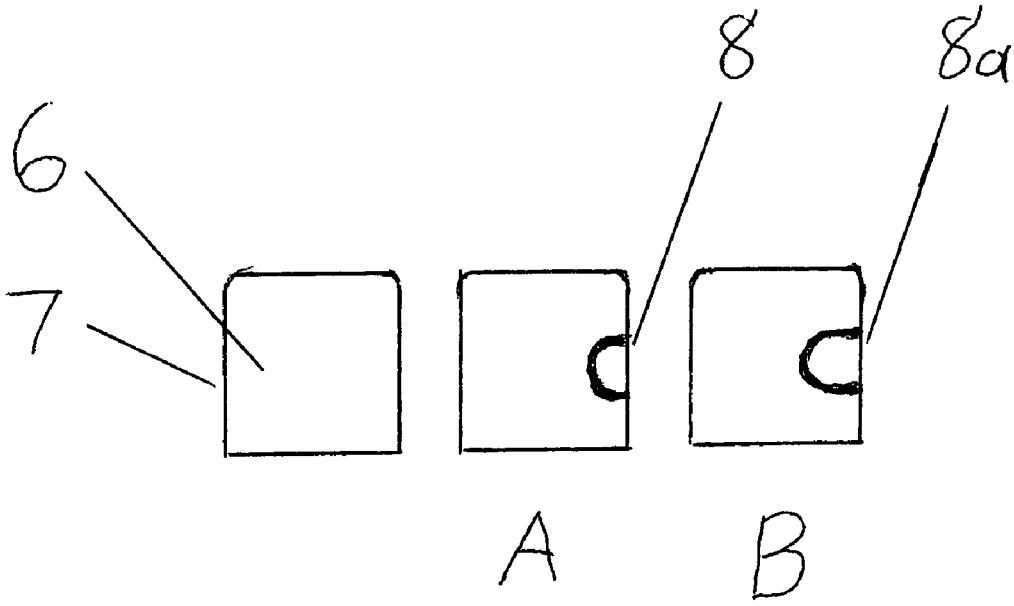
FIG. 2 is a side view of a standard projectile segment and two projectile segments with a center of mass offset central longitudinal axis of the cartridge.

FIG. 2 depicts three projectile segments. The center of mass of a projectile segment can be shifted from the central longitudinal axis in any number of ways. One embodiment is shown in FIG. 2, where a standard projectile segment 6 with a main body is displayed. Some mass can be removed from the side 7 or circumference of a projectile segment 6, or a projectile segment can be formed with mass already removed. Such an absence of mass from a side 7 can leave a recess 8, as depicted in projectile segment A, and a recess 8*a* as depicted in projectile segment B in FIG. 2. Projectile segment B in FIG. 2 has twice the mass removed compared to projectile segment A, and will strike the target approximately twice the distance away from the bullseye as projectile segment A. The absence of mass from a side of a projectile segment will cause the center of mass of a projectile segment to be shifted from the central longitudinal axis of the cartridge.

Figure 3:
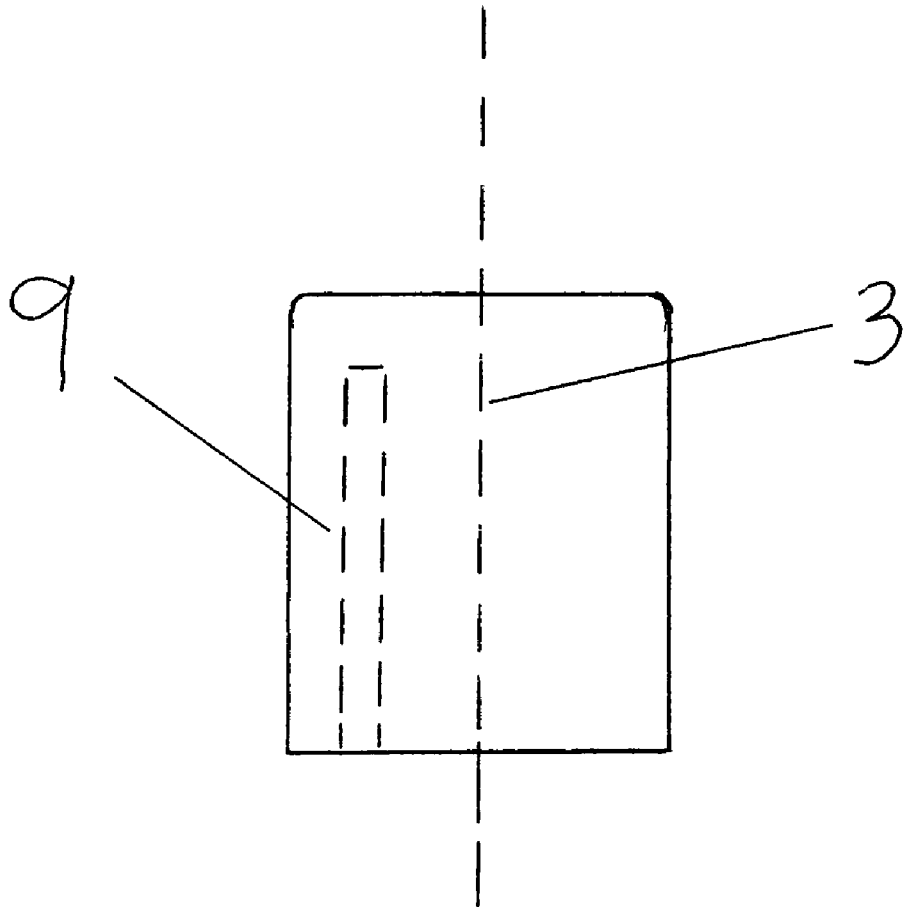
FIG. 3 is a side view of a projectile segment that has a center of mass offset from the central longitudinal axis of the cartridge.

FIG. 3. Shows a projectile segment that could be positioned in a cartridge case along with other projectile segments. In FIG. 3 another way of creating projectile segments with the centers of mass offset from the central longitudinal axis is shown. The center of mass of the projectile segment can be moved by means of a cavity 9 in the body between its side surface and its central longitudinal axis. The cavity can be created by drilling or other technique beneath the surface of the projectile segment. The cavity is parallel to the central longitudinal axis 3 of the projectile segment in FIG. 3 and lies along the longitudinal length of the projectile segment.

Figure 4:
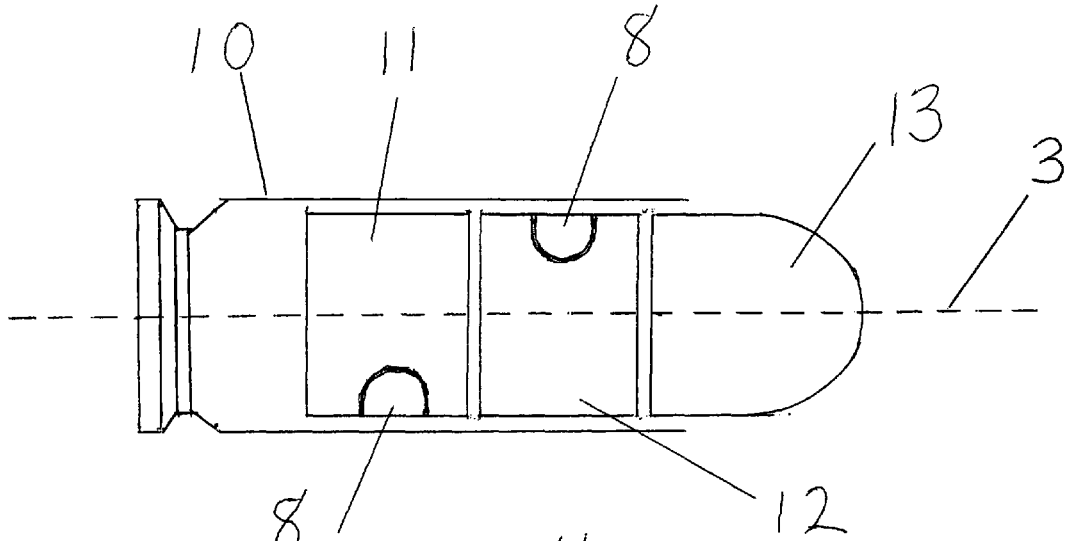
FIG. 4 is a side view of cartridge with three projectile segments.

FIG. 4 shows a hand gun or rifle cartridge 10 with three projectile segments. The cartridge 10 has a central longitudinal axis 3. Projectile segments 11 and 12 have an absence of mass in recess 8, and the projectile segments have centers of mass offset from the central longitudinal axis of the cartridge 3. The centers of mass of projectile segments 11 and 12 are radially oriented approximately 180 degrees apart in the cartridge 10. Projectile segment 13 is a standard projectile segment, with the center of mass lying along the central longitudinal axis of the cartridge.

Figure 5:
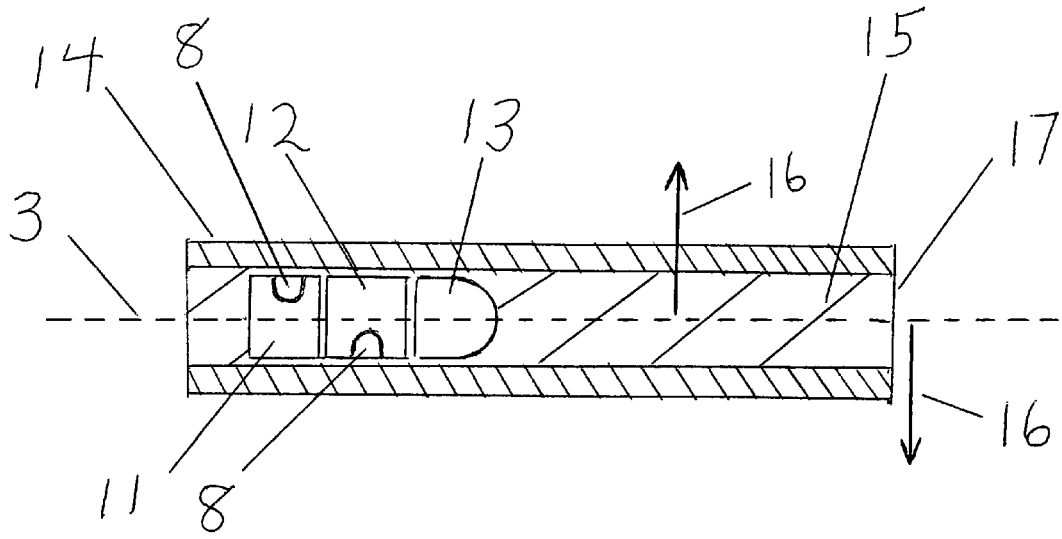
FIG. 5 is a side view of a rifled gun barrel with three projectile segments.

FIG. 5 displays a gun firing the projectile segments in FIG. 4. The gun barrel 14 with rifling 15 contains three projectile segments. A central longitudinal axis 3 is in the center of the gun barrel and the projectile. Two projectile segments 11 and 12 have a center of mass offset from the central longitudinal axis of the gun barrel with a recess 8 in the side of the projectile segments. The third projectile segment 13 has a center of mass on the central longitudinal axis of the gun barrel. The rifling 15 imparts a spin to the three projectile segments upon firing and passing through the barrel 14. The spin exerts a centrifugal force 16 on projectile segments 11 and 12 perpendicular to the longitudinal central axis of the barrel. Maximum turns in the rifling will spin the projectile segments faster and will cause projectile segments 11 and 12 to strike the target further away from the bullseye. As projectile segments 11 and 12 pass through the barrel 14, the centrifugal force will be perpendicular to the central longitudinal axis of the barrel, however, the force will constantly change in a circular direction because of the spin of the projectile segments. As projectile segments 11 and 12 pass through the exit 17, the centrifugal force will act on the projectile segments and they will diverge away from the trajectory of standard projectile segment 13.

The distance of the modified projectile segment strike points away from the bullseye is dependent on several factors. These include the distance the center of mass of the projectile segments is away from the central longitudinal axis of the cartridge, the turns in the rifling, the diameter of the projectile, as well as the range to the target.

An example of a 3 shot horizontal dispersion can be seen from a 30 caliber gun. The rifling is one turn in 12 inches. Two projectile segments, similar to projectile segments 11 and 12, with 10% of the mass removed by drilling a 3/16 hole in the side, are radially oriented approximately. 180 degrees in the cartridge case along with a standard projectile segment 13. The cartridge is then loaded in the proper rotational orientation in the gun barrel. Projectile segments 11 and 12 are fired simultaneously with projectile segment 13, and a horizontal strike pattern is created that is approx. 16" wide at 50 yards.

Figure 6:
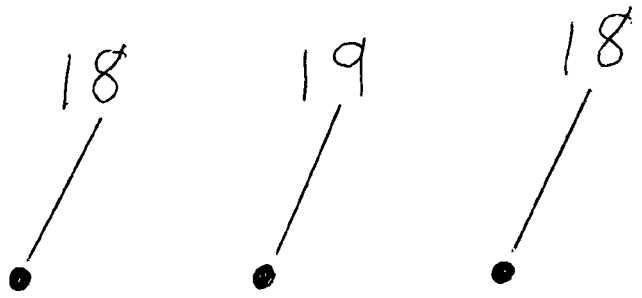
FIG. 6 is a view of a dispersal pattern.

FIG. 6 shows the horizontal dispersion strike pattern that is created by the three projectile segments that are fired simultaneously in the above example, and also from the gun barrel in FIG. 5. In FIG. 6 projectile segments 11 and 12 have target strikes at 18 that are on either side of the standard projectile segment 13 target strike at 19.

Figure 7:
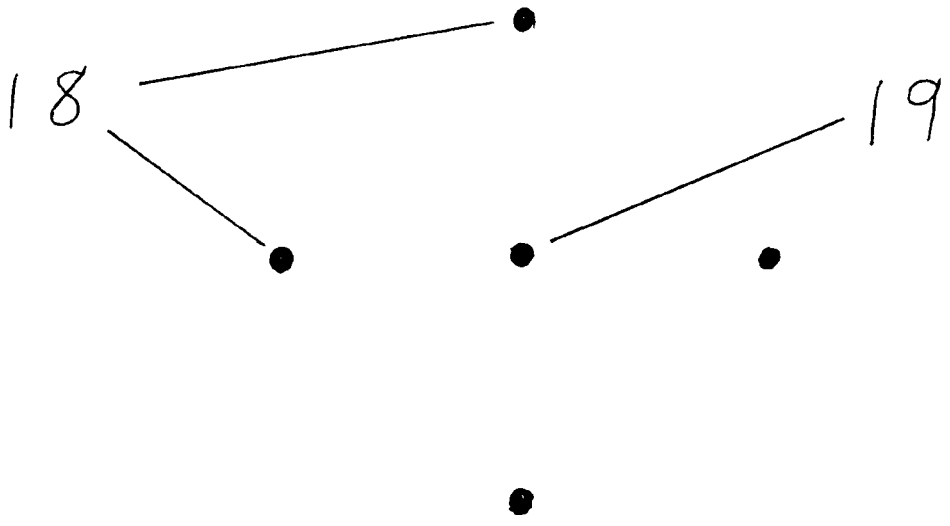
FIG. 7 is a view of a dispersal pattern.

FIG. 7 shows a dispersal pattern that could be created by a combination of a standard projectile segment fired simultaneously with four projectile segments with the centers of mass offset from the central longitudinal axis of the cartridge. The four projectile segments that have an offset center of mass would have to be radially orientated approximately 90 degrees from each other and contained within a cartridge along with a standard projectile segment. The cartridge would then be rotationally oriented in the gun and the projectile segments fired simultaneously from a rifled gun barrel. This would create the pattern in FIG. 7. Target strikes 18 are above and below and on either side of the standard projectile target strike at 19.

Figure 8:
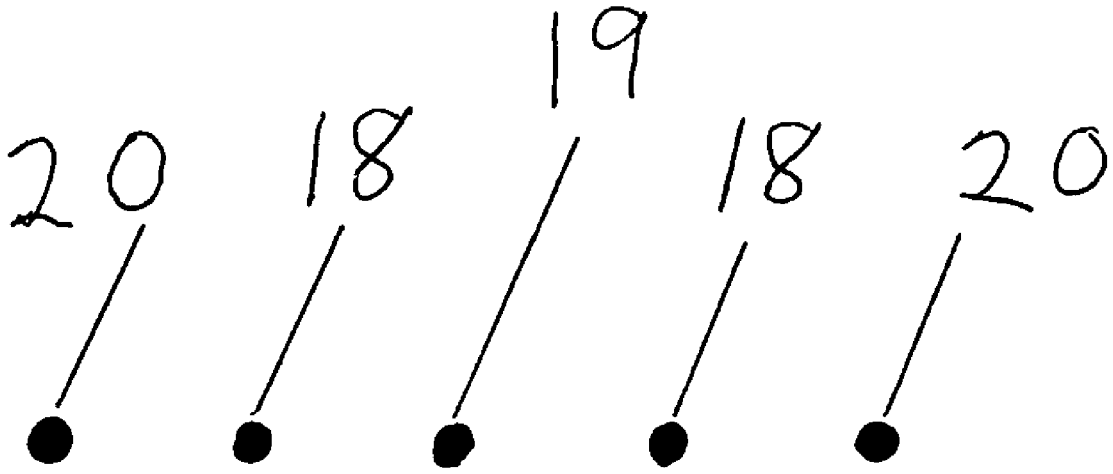
FIG. 8 is a view of a dispersal pattern.

FIG. 8 shows a dispersal pattern that could be created by the combination of a standard projectile segment and four projectile segments with the center of mass offset from the central longitudinal axis of the cartridge. Two of the offset center of mass projectiles would have centers of mass approximately twice the distance away from the central longitudinal axis of the cartridge compared to the other two offset center of mass projectiles. The four offset center of mass projectile segments, would have to be positioned in the proper radial orientation in the cartridge along with a standard projectile segment. Upon loading the cartridge in the proper rotational orientation and firing, the horizontal pattern in FIG. 8. is created. Target strikes 18 are on either side of standard projectile segment target strike 19, and target strikes 20 are twice the distance of 18 from the central target strike 19.

Figure 9:
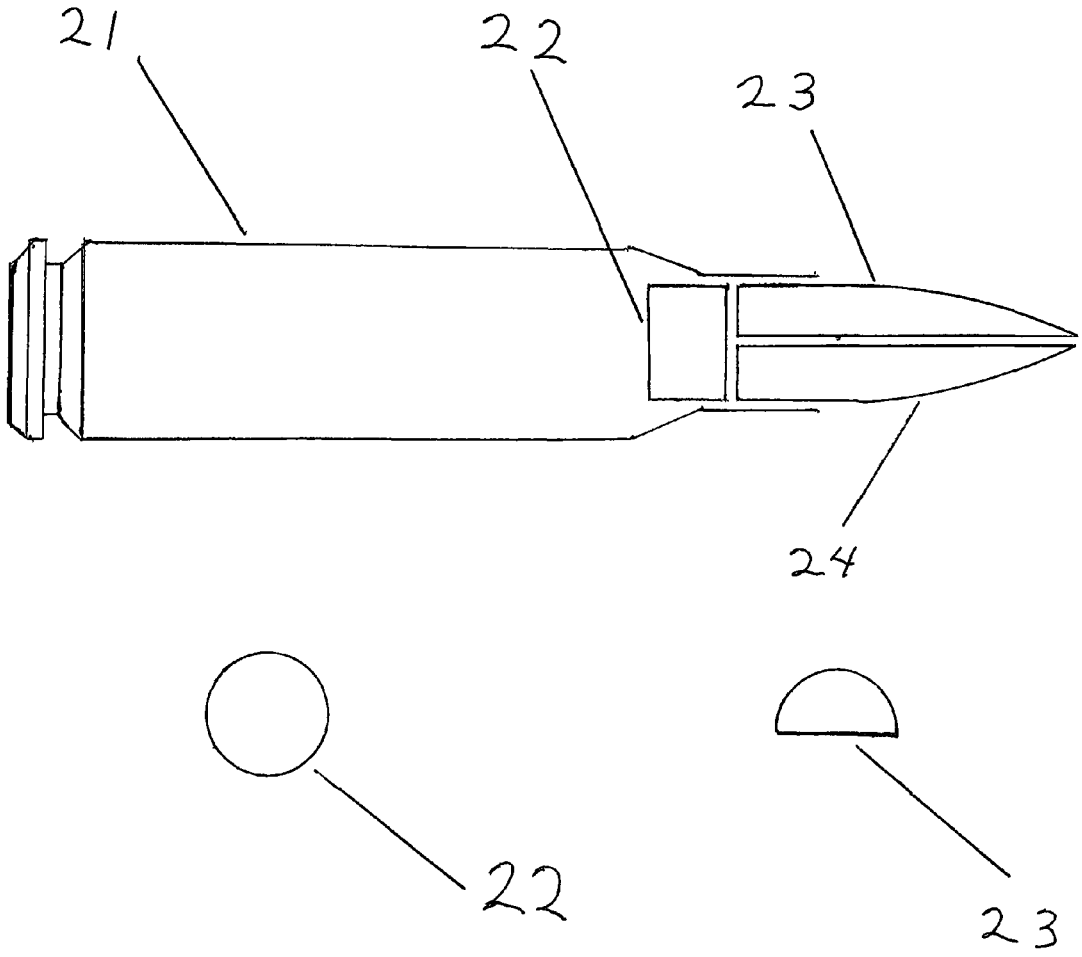
FIG. 9 is a cut away view of a cartridge case with three projectile segments.

FIG. 9 is a cutaway side view of a 7.62×39 cartridge containing 3 projectile segments. The cartridge case 21 contains the rear projectile segments 22 and the front projectile segments 23 and 24. There is also a front view of projectile segments 22, and a front view of projectile segments 23 and 24. When the cartridge is loaded in the proper rotational orientation and fired from a gun, the pattern in FIG. 6 is created. Projectile segments 23 and 24 have target strikes at 18 that are on either side of the standard projectile segment 22 target strike at 19. (The following figures were scaled up from a test firing at a shorter range.) Upon loading the cartridge in the proper rotational orientation in a gun with 1 in 9.75 twist and firing, the horizontal dispersion strike pattern in FIG. 6 is created that is 30 inches wide at 25 feet. By firing five 3 projectile segment cartridges that are rotationally oriented at five targets at 25 feet and superimposing the central strike points, the five projectile segment strike points on the left and on the right of the center are contained within 4 inch diameter circles.

The 3 projectile segment horizontal dispersion pattern in FIG. 6 can also be produced by using a 357 revolver. The gun has a 1 in 18.75 twist. It can be loaded with cartridges that are rotationally oriented, containing two forward side by, side projectile segments and a rear standard projectile segment. Upon firing at 25 feet a horizontal 3 projectile segment pattern dispersion is produced that is approx. 16 inches wide.

Figure 10:
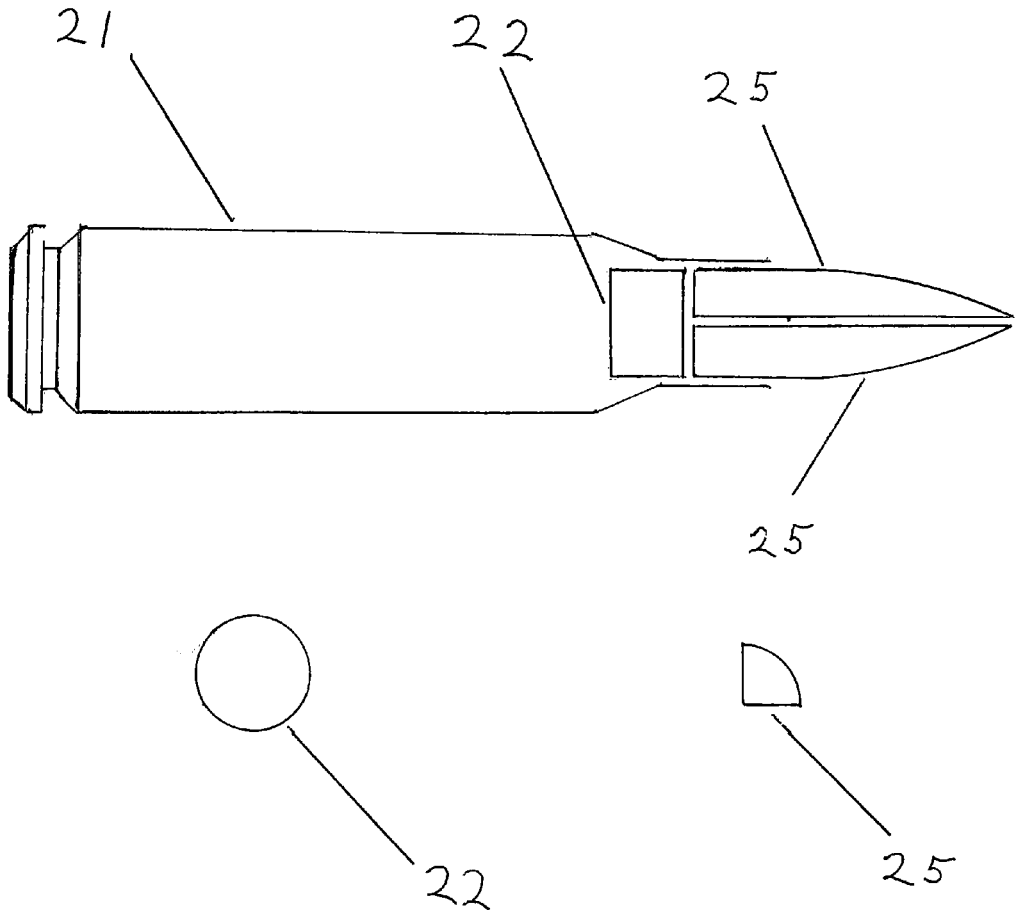
FIG. 10 is a cut away view of a cartridge case with five projectile segments.

FIG. 10 is a cutaway side view of a 7.62×39 cartridge containing 5 projectile segments. The cartridge case 21 contains the rear projectile segment 22 and four front projectile segments 25. There is also a front view of projectile segment 22, and a front view of the four projectile segments 25. When the cartridge is loaded in the proper rotational orientation and fired from a gun, the pattern in FIG. 7. Is created. The four projectile segments 25 have target strikes at 18 that are above and below and either side of the standard projectile segment 24 target strike at 19. (The following figures were scaled up from a test firing, at a shorter range.) Upon loading the cartridge in the proper rotational orientation in a gun with 1 in 9.75 twist and firing, the diamond shaped strike pattern in FIG. 7 is created that is 31 inches wide and 31 inches high at 25 feet. By firing five 5 projectile segment cartridges that are rotationally oriented at 5 targets at 25 feet and superimposing the central strike points, the 5 projectile segment strikes on the left and right of the center and above and below the center are all contained within 4½ inch diameter circles.

This type of 5 part projectile segment cartridge that provides a diamond shaped pattern when the cartridge is rotationally oriented, could also be randomly rotationally oriented, and produce randomly oriented square strike patterns that have substantially higher hit probabilities than a single shot.

Figure 11:
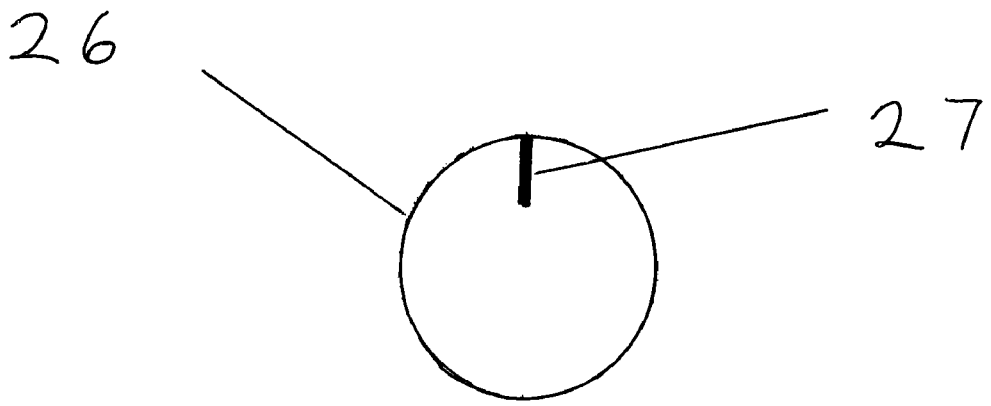
FIG. 11 is a view of markings on a cartridge for loading.

A marking on the aft end of the cartridges containing multiple projectile segments would be desirable to rotationally orient the cartridges properly upon loading, in order to create the desired patterns. FIG. 11. is a view of the aft end of cartridge 26 The mark 27 is a marking that could be rotationally oriented in the upward position in order to create the desired predetermined pattern upon firing.

Figure 12:
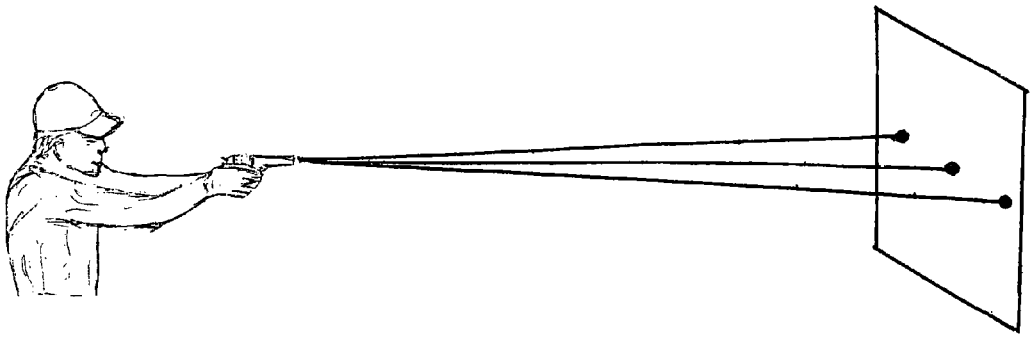
FIG. 12 is a drawing of a person firing a horizontal pattern dispersion salvo.

FIG. 12 is a diagram of a person firing a 3 projectile segment horizontal pattern dispersion salvo from a handgun.

Firing different combinations of standard projectile segments and projectile segments that have their center of mass various distances away from the central longitudinal axis, along with varying radial orientation of the centers of mass of the projectile segments will create many different patterns. Combinations are not limited to those mentioned herein, but may be infinite in variety.

The invention claimed is:

1. A system for projectile dispersion to improve the hit probability on a target comprising;

a gun having a rifled barrel;

a projectile having a main body, having a front end, a back end, and a side, positioned within a cartridge case, with a central longitudinal axis along the center of said cartridge case;

wherein said projectile is of slightly larger diameter than that of the gun barrel;

wherein said projectile is divided into three projectile segments;

wherein the majority of said projectile segments that are within said cartridge case are positioned so that the circumference of said projectile coincides with side surfaces of said projectile segments;

wherein two of said projectile segments that have centers of mass that are offset from said central longitudinal axis of the cartridge, are positioned side by side in said cartridge case;

wherein a standard projectile segment, with the center of mass aligned with said central longitudinal axis of the cartridge is positioned in said cartridge case;

wherein there is a means to radially orient said centers of mass of said projectile segments with said centers of mass offset from said central longitudinal axis of the cartridge at specific vectors of orientation prior to firing;

whereby each said projectile segment of the plurality of said projectile segments has a predetermined strike point, and a predetermined three projectile segment pattern is created when said two projectile segments with said centers of mass offset from said central longitudinal axis of the cartridge and said standard projectile segment are fired simultaneous by said gun on said target.

2. The system of claim 1 wherein;

said projectile segment with said centers of mass offset from said central longitudinal axis of the cartridge have said centers of mass located at substantially the same distance from said central longitudinal axis of the cartridge.

3. The system of claim 2 wherein;

said means to orient each projectile segment of said projectile segments with centers of mass offset from the central longitudinal axis of the cartridge is arranged to provide orientation of said centers of mass of said projectile segments at specific vectors of orientation, whereby the predetermined pattern is substantially linear and horizontal.

4. The system of claim 2 wherein;

said means to orient each projectile segment of said projectile segments with centers of mass offset from the central longitudinal axis of the cartridge is arranged to provide orientation of said centers of mass of said projectile segments at specific vectors of orientation, whereby the predetermined pattern is substantially vertical.

5. The system of claim 2 wherein;

in combination projectile segments with the center of mass offset from the central longitudinal axis of the cartridge and a means for providing said projectile segments to spin around their fore and aft axises after firing.

6. The system of claim 2 wherein;

projectile segments with the center of mass offset from the central longitudinal axis of the cartridge have substantially flat ends, whereby said projectile segments spin around their for and aft axis after firing.

7. The system of claim 1 further including;

a means of indicating said rotational orientation of said cartridge with said plurality of projectile segments, some of which have said centers of mass with specific vectors of orientation in relation to said central longitudinal axis of said cartridge.

8. A method for projectile dispersion to improve the hit probability on a target comprising;

providing a gun having a rifled barrel;

providing a projectile having a main body, having a front end, a back end, and a side, positioned within a cartridge case with a central longitudinal axis lying along the center of said cartridge case;

providing said projectile with a diameter slightly larger than that of the gun barrel;

dividing said projectile into three projectile segments;

positioning the majority of said projectile segments within said cartridge so that the circumference of said projectile is coinciding with side surfaces of said projectile segments;

providing said two projectile segments having said centers of mass offset from said central longitudinal axis of the cartridge, positioned side by side in said cartridge case;

providing a standard projectile, with the center of mass aligned with said central longitudinal axis of the cartridge positioned in said cartridge case;

orienting radially said centers of mass of said projectile segments having centers of mass offset from said central longitudinal axis of the cartridge at specific vectors of orientation, prior to firing;

firing simultaneously from said gun the plurality of said projectile segments contained in said cartridge, each which have a predetermined strike point which creates a predetermined three projectile segment pattern on said target when said two projectile segments, with said centers of mass offset from said central longitudinal axis of the cartridge and said standard projectile segment are contained in said cartridge.

9. A method as recited in claim 8 wherein;

shifting said centers of mass of said projectile segments with said centers of mass offset from the central longitudinal axis of the cartridge involves locating said centers of mass at substantially the same distance from said central longitudinal axis of the cartridge.

10. A method as recited in claim 9 wherein;

orienting said projectile segments with centers of mass offset from said central longitudinal axis of the cartridge is arranged to provide orientation of said centers of mass of said projectile segments at specific vectors of orientation, whereby said predetermined pattern is substantially linear and horizontal.

11. A method as recited in claim 9 wherein;

orienting said projectile segments with centers of mass offset from the central longitudinal axis of the cartridge is arranged to provide orientation of said centers of mass of said projectile segments at specific vectors of orientation whereby the predetermined pattern is substantially vertical.

12. A method as recited in claim 9 wherein;

combining said projectile segments with the center of mass offset from the central longitudinal axis of the cartridge and a means for providing said projectile segments to spin around their fore and aft axis after firing.

13. A method as recited in claim 9 wherein;

providing projectile segments with the center of mass offset from the central longitudinal axis of the cartridge with substantially flat ends, whereby said projectile segments spin around their for and aft axis after firing.

14. The method as recited in claim 8 further including;

indicating said rotational orientation of said cartridge with said plurality of projectile segments, some of which have said centers of mass with specific vectors of orientation in relation to said central longitudinal axis of said cartridge.

* * * * *